US005722132A

United States Patent [19]

Jones

[11] Patent Number: 5,722,132

[45] Date of Patent: Mar. 3, 1998

[54] LOCKING DEVICE FOR RECEIVING AND REMOVABLE, RETAINING THEREIN A STRETCHABLE LACE

[76] Inventor: David Jones, 6064 Vista Linda La., Boca Raton, Fla. 33433

[21] Appl. No.: 788,485

[22] Filed: Jan. 28, 1997

[51] Int. Cl.[6] ..... F16G 11/00

[52] U.S. Cl. ..... 24/712.1; 24/712.2; 24/712.3

[58] Field of Search ..... 24/712.1, 712.2, 24/712.3, 712.9, 713.6, 715.3

[56] References Cited

U.S. PATENT DOCUMENTS

| | | | |
|---|---|---|---|
| 819,884 | 5/1906 | Higgins | 24/712.2 |
| 3,106,003 | 10/1963 | Herdman | 24/712.3 |
| 3,122,805 | 3/1964 | Hakim | 24/712.3 |
| 3,132,390 | 5/1964 | Boden . | |
| 3,845,575 | 11/1974 | Boden . | |
| 4,102,019 | 7/1978 | Boden . | |
| 4,393,550 | 7/1983 | Yang et al. . | |
| 5,022,127 | 6/1991 | Ang | 24/712.2 |
| 5,029,371 | 7/1991 | Rosenblood et al. . | |

FOREIGN PATENT DOCUMENTS

| | | | |
|---|---|---|---|
| 0572449 | 1/1958 | Italy | 24/712.1 |

*Primary Examiner*—Victor N. Sakran
*Attorney, Agent, or Firm*—Panitch Schwarze Jacobs & Nadel, P.C.

[57] ABSTRACT

A locking device is employed for receiving and removably retaining therein a stretchable or elastic lace. The locking device comprises a base member having generally parallel flat first and second principal surfaces. The first principal surface of the base member includes a pair of rib members and a pair of wall members with grooves formed therebetween. The locking device further includes a decorative cover member generally in the shape of and configured to simulate a three-dimensional character, figure, design, or object. The cover member has a generally flat first surface which includes a pair of rib members and a pair of wall members that form grooves therebetween. The base member is secured to the cover member with the respective first surfaces facing each other such that the rib members and grooves are aligned and the wall members are in engagement. The aligned rib members establish open areas of a size sufficient for passing portions of a stretched lace therethrough and the aligned grooves establish lace receiving areas large enough for receiving the stretched lace portions passing through the open areas but small enough to grip and hold the received lace portions when in an unstretched condition.

13 Claims, 2 Drawing Sheets

LOCKING DEVICE FOR RECEIVING AND REMOVABLE, RETAINING THEREIN A STRETCHABLE LACE

FIELD OF THE INVENTION

The present invention relates to a locking device for receiving and removably retaining therein a stretchable lace and, more particularly, to such a locking device for use with stretchable or elastic laces of shoes, such as sneakers, tennis shoes, athletic shoes, and the like.

BACKGROUND OF THE INVENTION

Sneakers, tennis shoes, athletic shoes, and the like (hereinafter "athletic shoes") typically include stretchable or elastic laces for the purpose of holding the shoe tightly and firmly on the foot of the user while providing at least slight stretchability to accommodate variations in tension or compression resulting from running, jumping, or other athletic activities. Typically, after lacing up athletic shoes, a user pulls the laces tightly and ties the laces in a bow or knot in the usual well-known manner. While engaging in athletic activity or even walking or other movement, such traditional bows or knots tend to become loose thereby causing the shoe to not be maintained on the user's foot as snugly as desired. Sometimes, the bows or knots become completely untied. In either situation, the performance of the user deteriorates at best and, at worst, the user may stumble or fall as a result of the loosened or untied lace. At the very minimum, the user must periodically interrupt his or her activities and either retie a lace that has become untied or untie and retie a lace which has become unacceptably loose.

The present invention overcomes the problems associated with the use of such stretchable or elastic laces in athletic footwear by providing an inexpensive locking device which permits a user to quickly and conveniently secure such laces with a desired degree of snugness. The locking device grips and holds the laces in the desired position until the user desires to remove the shoes. The locking device of the present invention contains no moving parts and can be quickly and easily installed and used to grip or clamp shoelaces in a secure position by simply pulling the stretched laces apart in a swift motion. The laces can be just as quickly and easily removed by simply stretching and pulling the laces toward each other and away from the gripping action of the locking device. In addition, the locking device of the present invention includes a decorative cover member in the shape of and configured to simulate a three-dimensional character, figure, design, or object. For example, the present locking device may be configured to include a decorative cover member in the shape of a cartoon character, a sports object, such as a football helmet, basketball, etc., a sports figure, such as Michael Jordan, a company or team logo or figure, or the like.

SUMMARY OF THE INVENTION

Briefly stated, the present invention comprises a locking device for receiving and removably retaining therein a stretchable lace, such as a shoelace. The locking device comprises a base member having generally parallel, flat first and second principal surfaces. The first surface of the base member includes a pair of rib members extending outwardly therefrom by a first predetermined distance, the rib members being spaced from each other. The rib members each have a predetermined thickness, a predetermined maximum height, a first side wall sloping outwardly from the first surface, and a second side wall extending generally perpendicularly outwardly from the first surface. The sloping side walls of the rib members generally face each other. The base member further includes a pair of wall members extending outwardly therefrom by a second predetermined distance. The wall members each have a side wall extending generally perpendicularly outwardly from the first surface of the base member such that the side walls of the wall members are each spaced from and facing the second side wall of one of the rib members to establish grooves therebetween. The thickness of the grooves is generally consistent along the lengths of the grooves and is of a third predetermined distance. The locking member further includes a decorative cover member generally in the shape of and configured to simulate a three-dimensional character, figure, design, or object. The cover member has a generally flat first surface. The first cover member surface includes a pair of rib members extending outwardly therefrom by a first predetermined distance. The rib members are spaced from each other. The rib members each have a predetermined thickness and a predetermined maximum height. Each rib member further includes a side wall sloping outwardly from the first cover member surface and a second side wall extending generally perpendicularly outwardly from the first cover member surface, the sloping side walls of the rib members generally facing each other. The first cover member surface further includes a pair of wall members extending outwardly therefrom by a second predetermined distance, the wall members each having a side wall extending generally perpendicularly outwardly from the first cover member surface. The side walls of each of the wall members are each spaced from and face the second side wall of one of the rib members to establish grooves therebetween. The thickness of the grooves is consistent along their entire lengths and is of a third predetermined distance. The base member is secured to the cover member with the respective first surfaces facing each other such that the rib members and grooves of the base member are aligned with the rib members and grooves of the cover member and the wall members of the base member engage the wall members of the cover member. The aligned rib members establish sloped open areas of a size sufficient for passing portions of a stretched lace therethrough and the aligned arcuate grooves are of a size large enough for receiving the stretched lace portions passed through the open areas but small enough to grip and hold received lace portions when in an unstretched condition.

BRIEF DESCRIPTION OF THE DRAWINGS

The foregoing summary, as well as the following detailed description of a preferred embodiment of the invention, will be better understood when read in conjunction with the appended drawings. For the purpose of illustrating the present invention, there is shown in the drawings an embodiment which is presently preferred, it being understood, however, that the invention is not limited to the precise arrangements and instrumentalities shown. In the drawings.

DETAILED DESCRIPTION OF PREFERRED EMBODIMENT

Figure 1:
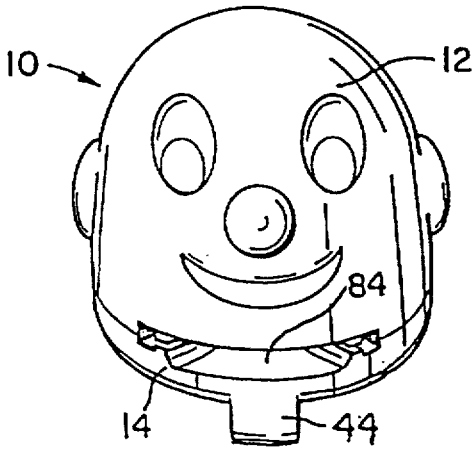
FIG. 1 is a perspective view of a decorative locking device in accordance with a preferred embodiment of the present invention.
Figure 2:
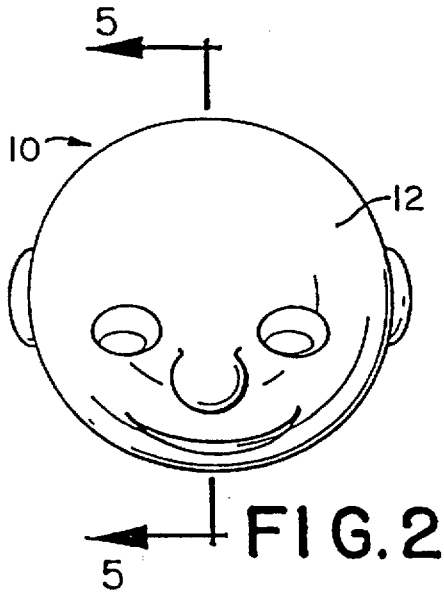
FIG. 2 is a top plan view of the decorative locking device of FIG. 1.
Figure 3:
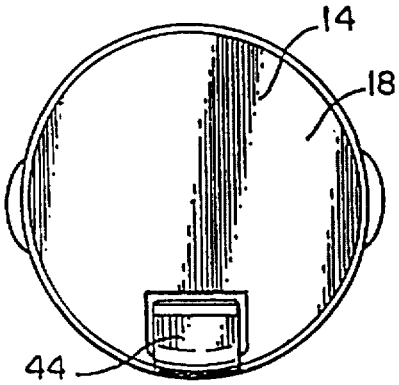
FIG. 3 is a bottom plan view of the decorative locking device of FIG. 1.

Referring to the drawings, wherein the same reference numerals are used to indicate the same components throughout the several figures, there is shown in FIG. 1 a perspective view of a decorative locking device 10 in accordance with a preferred embodiment of the present invention. The decorative locking device 10 of the present invention is preferably employed for receiving and removably retaining therein the distal ends of a stretchable or elastic lace (not shown) such as a shoelace of the type employed with a sneaker, tennis shoe, athletic shoe, or the like (not shown). Locking devices of the type employed for receiving and retaining shoelaces, such as stretchable shoelaces, are generally well known in the art. Such locking devices are disclosed in U.S. Pat. Nos. 3,845,575; 4,102,019; 4,393,550; and 5,029,371, the subject matter of each of which is hereby incorporated herein by reference. The manner in which the present decorative locking device 10 is employed can be understood by reference to each of the above-identified patents and, in particular, to U.S. Pat. No. 5,029,371, which discloses a device having some structural and operational features which are similar to corresponding structural and operational features of the present decorative locking device 10. However, the present decorative locking device 10 includes numerous structural and operational features which are different from those employed in the locking device of U.S. Pat. No. 5,029,371 and the other above-identified patents as will be hereinafter described in greater detail.

In addition, the decorative locking device 10 of the present invention differs from the devices disclosed in each of the above-identified patents in that the decorative locking device of the present invention includes a decorative cover member 12 which is generally in the shape of and configured to simulate a three-dimensional character, figure, design, or object. In the illustrated embodiment, the decorative cover member 12 is in the shape of and is configured to simulate a generic cartoon figure. However, it will be appreciated by those of ordinary skill in the art that the cartoon figure as shown in the drawings is only for purposes of illustrating the presence of the cover member 12. It should, therefore, be clearly understood that the decorative cover member 12 can be of virtually any shape or configuration for the purpose of simulating any type of three-dimensional character, figure, design, or object. For example, the decorative cover member 12 could be in the shape of and configured to simulate a well-known cartoon character such as Bugs Bunny, Mickey Mouse, Woody Woodpecker, a Power Ranger, a Mutant Ninja Turtle, or the like; any other inanimate character such as Cookie Monster, Superman, Batman, etc.; an animate character such as a living or non-living sports personality, a living or non-living television, movie, or theater personality, a living or non-living performing or recording artist, or the like; an inanimate object such as an object associated with a particular sport (i.e., a football helmet, basketball, etc.); an object associated with a particular occupation (i.e., police badge, fireman's helmet, etc.); an object associated with a particular company or organization such as a logo; an art object or the like; or virtually any type of design with which a user could potentially wish to be associated. It should, therefore, be clearly understood that the present invention applies to any such character, figure, design, or object, and is clearly not limited to the generic figure shown in the drawings.

Figure 4:
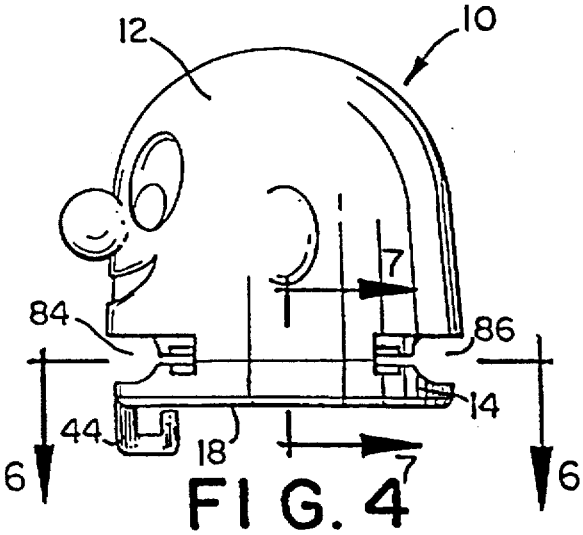
FIG. 4 is a right-side elevational view of the decorative locking device of FIG. 1.
Figure 5:
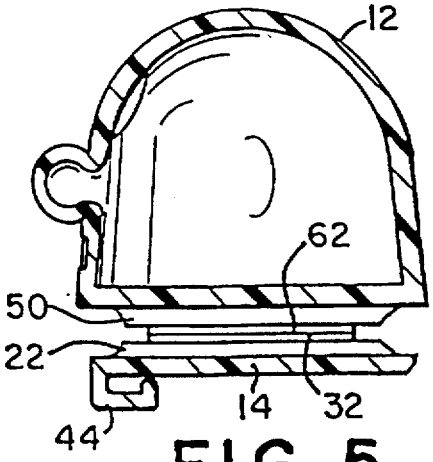
FIG. 5 is a sectional view of the decorative locking device taken along line 5—5 of FIG. 2.
Figure 6:
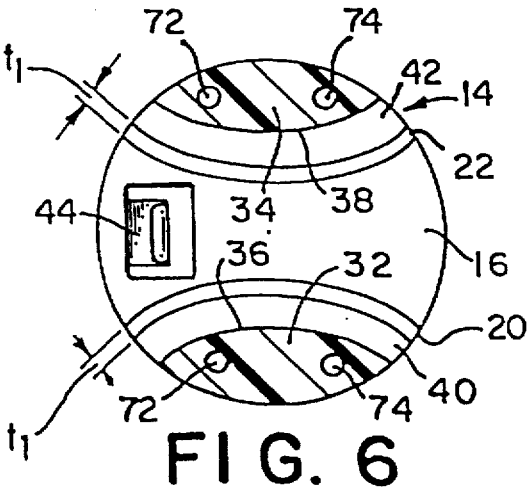
FIG. 6 is a sectional view of the decorative locking device taken along line 6—6 of FIG. 4.
Figure 7:
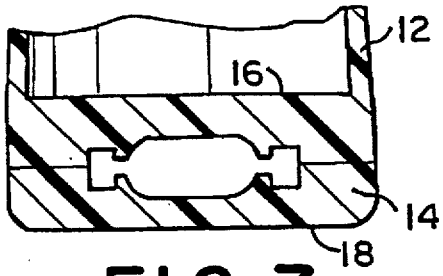
FIG. 7 is sectional view of a portion of the decorative locking device taken along line 7—7 of FIG. 4.
Figure 9:
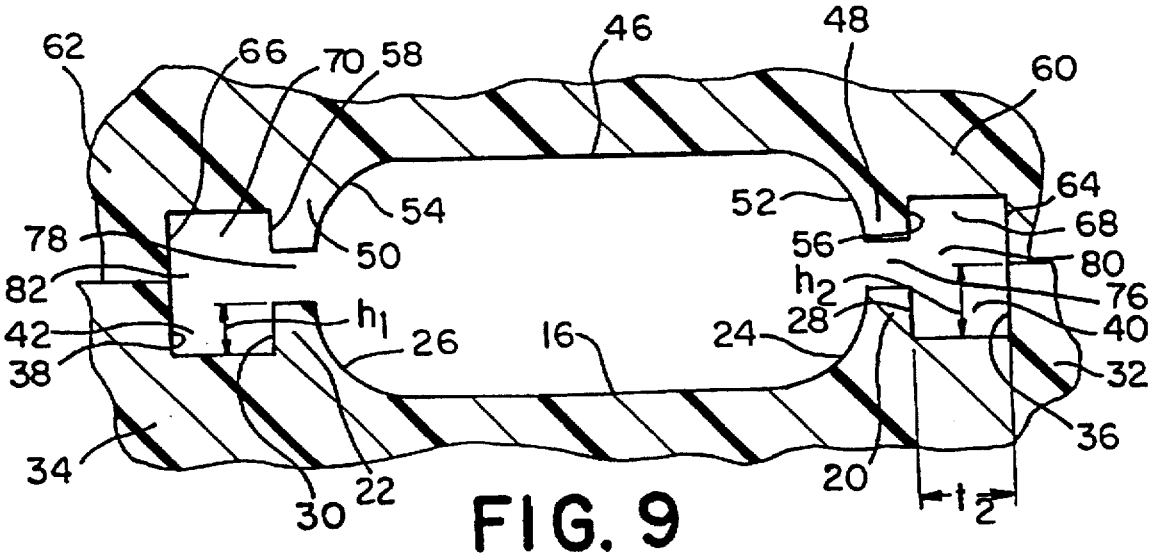
FIG. 9 is an enlarged view of a portion of FIG. 7.

As best illustrated in FIGS. 4–7 and 9, the decorative locking device 10 comprises a generally disc-like base member 14 having generally parallel, flat first and second principal surfaces 16, 18, respectively. As best illustrated by FIGS. 6, 7 and 9, the base member 14 includes a pair of generally arcuate rib members 20, 22 extending outwardly or upwardly from the first principal surface 16. The rib members 20,22 are spaced from each other with the arcs formed by the rib members 20, 22 being generally of the same radius of curvature but with opposite orientations so that the rib members 20, 22 diverge from each other as best shown in FIG. 6. The rib members 20, 22 each have a predetermined lateral thickness $t_1$ as shown in FIG. 6 and a predetermined maximum height $h_1$ as shown in FIG. 9.

Each of the rib members 20, 22 includes a first, generally curved side wall 24, 26, respectively, sloping outwardly from the first principal surface 16 of the base member 14. Each rib member 20, 22 further includes a second, generally curved side wall 28, 30 extending generally perpendicularly outwardly from the first principal surface 16 of the base member 18. As best illustrated in FIG. 6, the sloping side walls 24, 26 of the rib members 20, 22 generally face each other and face toward the center of the base member 14.

The first principal surface 16 of the base member 14 further includes a pair of wall members 32, 34 extending outwardly therefrom by a second predetermined distance. The wall members 32, 34 each include a generally curved side wall 36, 38 extending generally perpendicularly outwardly from the first principal surface 16 of the base member 14. The curved side walls 36, 38 of the wall members 32, 34 are each spaced from and generally facing the second side wall 28, 30 of the respective one of the rib members 20, 22. The curved side walls 36, 38 of the wall members 32, 34 each have a radius of curvature which is at least slightly less than the radius of curvature of the respective rib members 20, 22, to establish generally arcuate grooves 40, 42 therebetween. The thickness $t_2$ of the arcuate grooves 40, 42 is generally consistent throughout the curved length of the grooves and is of a third predetermined distance.

As best shown in FIGS. 4–6, the base member 14 also includes a clip 44 which extends generally outwardly beyond the second principal surface 18. The clip 44 is generally U-shaped in cross-section and is employed to facilitate attachment of the locking device 10 to a portion of the lace between the eyelets to effectively hold the locking device 10 in place on the shoe of a user. Preferably, when the locking device 10 is in use, the clip 44 is secured onto the underside of one of the laces between the eyelets to effectively hold the locking device 10 in place with the decorative cover member 12 extending outwardly from the shoe of the user to be clearly visible.

The decorative cover member 12 includes a generally flat, first surface 46 generally on the undersurface thereof. The first cover member surface 46 is formed to have substantially the same shape and configuration as the first principal surface 16 of the base member 14. That is, the first cover member surface 46 includes a pair of generally arcuate rib members 48, 50 (see FIG. 9) extending outwardly therefrom by the first predetermined distance. The rib members 48, 50 are spaced from each other with the arcs formed by the rib members 48, 50 being generally of the same radius of curvature but with opposite orientations and also being generally the same as the rib members 20, 22 of the base member 14. The rib members 48, 50 of the first cover member surface 46 each have a predetermined thickness which corresponds to the thickness $t_1$ of rib members 20, 22 and a predetermined maximum height which corresponds to the maximum height $h_1$ of rib members 20, 22. The rib members 48, 50 each include a generally curved side wall 50, 52 sloping outwardly from the first cover member surface 46 and a second generally curved side wall 56, 58 extending generally perpendicularly outwardly from the first cover member surface 46 with the sloping side walls 52, 54 facing each other in substantially the same manner as with rib members 20, 22.

A pair of wall members 60, 62 extend outwardly from the first cover member surface 46 by the second predetermined distance. The wall members 60, 62 each have a generally curved side wall 64, 66 extending generally perpendicularly outwardly from the first cover member surface 46 in substantially the same manner as the curved side walls 36, 38 of the wall members 32, 34 of rib members 20, 22. The side walls 64, 66 of wall members 60, 62 are spaced from and facing the second side walls 56, 58 of the respective rib members 48, 50 and have a radius of curvature slightly less than the radius of curvature of the respective rib members 48, 50 to establish generally arcuate grooves 68, 70 therebetween. The thickness of the grooves 68, 70 is consistent along their entire lengths and is substantially the same as the thickness $t_2$ of the arcuate grooves 40, 42 of the base member 14.

Preferably, the base member 14 and the decorative cover member 12 are formed of a polymeric material such as polyvinylchloride (PVC), polyethylene, polypropylene, or the like. The base member 14 and the decorative cover member 12 are preferably separately fabricated utilizing any process known to those of ordinary skill in the art and preferably are formed by injection molding or the like. If desired, the base member 14 and decorative cover member 12 may be fabricated as a single unit.

Assuming that the base member 14 and decorative cover member 12 are formed as separate units, they must thereafter be joined together to form the decorative locking device 10. In the embodiment shown in the drawings, one of the base member 14 and the decorative cover member 12 includes at least one pin and preferably four pins 72 and the other of the base member 14 and decorative cover member 12 includes at least one opening and preferably four openings 74. In the illustrated embodiment, both the base member 14 and the decorative cover member 12 includes two pins 72 and two openings 74. It will, of course, be appreciated that any other suitable arrangement of pins 72 and openings 74 may be employed as desired. In the illustrated embodiment, the pins 72 are generally cylindrical and the openings 74 are generally circular with the outer diameter of the pins 72 being slightly greater than the inner diameter of the openings 74 so that when the base member 14 and decorative cover member 12 are joined, the pins 72 extend into the openings 74 and are maintained therein with a tight interference fit. It will be appreciated by those of ordinary skill in the art that the size and shape of the pins 72 and openings 74 may vary. Although it is preferred that pins 72 and openings 74 be provided in order to facilitate alignment when securing the base member 14 to the cover member 12, it will be appreciated that pins 72 and openings 74 are not necessarily required. The base member 14 may be secured to the decorative cover member 12 in any other known manner such as by using a suitable adhesive, ultrasonically welding together the two components, using one or more threaded fasteners or screws, or the like. Accordingly, the manner in which the base member 14 is secured to the decorative cover member 12 is not meant to be a limitation upon the present invention.

As best shown in FIGS. 7 and 9, when the base member 14 and decorative cover member 12 are assembled together, the above-discussed components on the principal surface 16 of the base member are aligned with the corresponding components on the first cover member surface 46. That is, rib members 20, 22 are aligned with rib members 48, 50 and wall members 32, 34 are aligned with and engage wall members 60, 62. The aligned rib members 20, 22, 48, 50 establish curved, sloped, open areas 76, 78 therebetween with each of the open areas 76, 78 being of a size sufficient for passing portions of a stretched lace therethrough. The arcuate grooves 40, 42 of the base member 14 are aligned with the arcuate grooves 68, 70 of the cover member 12 to establish lace receiving areas 80, 82. Preferably, the lace receiving areas 80, 82 are of a size large enough for receiving portions of a lace when in a stretched condition after the lace portions pass through the open areas 76, 68 but are small enough to tightly engage, grip, and hold the received lace portions when in an unstretched condition.

Figure 8:
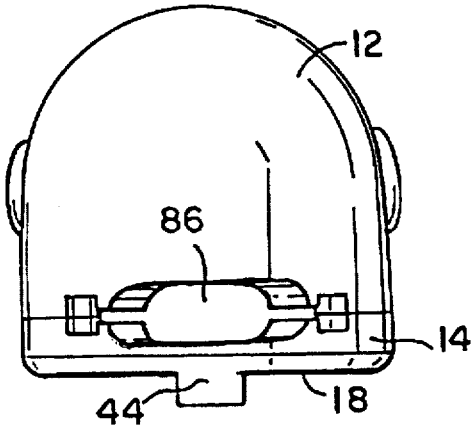
FIG. 8 is a rear elevational view of the decorative locking device of FIG. 1.

As best shown in FIGS. 1, 4 and 5, when the base member 14 is secured to the decorative cover member 12, a lace inlet 84 is formed on the front surface of the decorative locking device 10. Similarly, as best shown in FIGS. 4, 5 and 8, a lace outlet 86 is formed on the rear surface of the decorative locking device 10. As illustrated, the lace inlet 84 is located opposite from the lace outlet 86.

To use the decorative locking device 10, a user first laces his or her shoe by passing the stretchable lace through the eyelets in the shoe in the usual manner. Once lacing of the shoe has been completed, both distal ends of the shoelace are inserted into the lace inlet 84 and out of the lace outlet 86 with the decorative locking device 10 proximate to the shoe. Thereafter, the user tightens the lace to the desired degree of tightness and pulls on the distal ends of the lace and separates the distal ends from each other by pulling each distal end sideways within the locking device 10. The stretching and sideways pulling of the distal ends of the lace causes the portion of the lace within the decorative locking device 10 to pass through the open areas 76, 78 between the rib members 20, 22, 48, 50 and into the lace receiving areas 80, 82 formed by the aligned grooves 40, 42, 68, 70. Preferably, the pulling of the distal ends of the lace is with a swift motion until such time as the lace ends snap into place within the lace receiving areas 80, 82. Upon releasing the lace ends, the portions of the lace within the lace receiving areas 80, 82 expand outwardly to tightly engage the grooves 40, 42, 68, 70 within the decorative locking device 10 which effectively holds the lace ends in place without significant movement. The user may then attach the clip 44 to a portion of the lace between the eyelets to hold the locking device 10 in place on the shoe with the decorative cover member 12 facing outwardly to be viewed on the shoe. The decorative locking device 10 will effectively keep the lace in a secured position for as long as desired. Removal of the decorative locking device 10 is accomplished by reversing the process. That is, after removing the clip 44 from the lace 80, the distal ends of the lace are stretched and then pulled inwardly toward each other thereby removing the lace from the lace receiving areas 80, 82.

From the foregoing description, it can be seen that the present invention comprises a decorative locking device for receiving and removably retaining therein a stretchable or elastic lace, such as a shoelace. It will be recognized by those skilled in the art that changes may be made to the above-described embodiment of the invention without departing from the broad inventive concepts thereof. For example, the rib members, wall members, grooves, etc., could be straight or in some other configuration such as partially straight and partially curved, if desired. It is understood, therefore, that this invention is not limited to the particular embodiments disclosed, but is intended to cover all modifications which are within the spirit and scope of the invention as defined by the appended claims.

I claim:

1. A locking device for receiving and removably retaining therein a stretchable lace, the device comprising:

a base member having generally parallel, flat first and second principal surfaces, the first surface including, a pair of rib members extending outwardly therefrom by a first predetermined distance, the rib members being spaced from each other and each having a predetermined thickness, a predetermined maximum height, a first side wall sloping outwardly from the first surface and a second side wall extending generally perpendicularly outwardly from the first surface, the sloping side walls of the rib members generally facing each other, and a pair of wall members extending outwardly therefrom by a second predetermined distance, the wall members each having a side wall extending generally perpendicularly outwardly from the first surface, the side walls of the wall members each being spaced from and facing the second side wall of one of the rib members to establish grooves therebetween, the thickness of the grooves being consistent and of a third predetermined distance along their lengths; and a decorative cover member generally in the shape of and configured to simulate a three dimensional character, figure, design, or object, the cover member having a generally flat first surface, the first cover member surface including, a pair of rib members extending outwardly therefrom by the first predetermined distance, the rib members being spaced from each other and each having a predetermined thickness, a predetermined maximum height, a first side wall sloping outwardly from the first cover member surface and a second side wall extending generally perpendicularly outwardly from the first cover member surface, the sloping side walls of the rib members generally facing each other, and a pair of wall members extending outwardly therefrom by the second predetermined distance, the wall members each having a side wall extending generally perpendicularly outwardly from the first cover member surface, the side walls of the wall members each being spaced from and facing the second side wall of one of the rib members to establish grooves therebetween, the thickness of the grooves being consistent and of the third predetermined distance along their lengths, the base member being secured to the cover member with the respective first surfaces facing each other such that the rib members and grooves of the base member are aligned with the rib members and grooves of the cover member and the wall members of the base member engage the wall members of the cover member, the aligned rib members establishing sloped open areas of a size sufficient for passing portions of a stretched lace therethrough and the aligned grooves being of a size large enough for receiving the stretched lace portions passed through the open areas but small enough to grip and hold the received lace portions when in an unstretched condition.

2. The locking device as recited in claim 1 wherein the rib members and wall member side walls are generally curved and the grooves are arcuate.

3. The locking device as recited in claim 2 wherein the sloped open areas between the aligned rib members and the size of the areas established by the aligned arcuate grooves may be changed to accommodate laces having different widths and thicknesses.

4. The locking device as recited in claim 1 wherein the second principal surface of the base member includes a clip to facilitate attachment of the locking device to the lace to hold the locking device in place.

5. The locking device as recited in claim 1 wherein the base member and the cover member are made of polymeric materials.

6. The locking device as recited in claim 1 wherein the cover member is in the shape of and is configured to simulate an animated character.

7. The locking device as recited in claim 1 wherein the cover member is in the shape of and is configured to simulate a non-animated character.

8. The locking device as recited in claim 1 wherein the cover member is generally in the shape of and is configured to simulate an object associated with a sport or other activity.

9. The locking device as recited in claim 1 wherein the cover member is generally in the shape of and is configured to simulate a person associated with a sport or other activity.

10. The locking device as recited in claim 1 further including a lace inlet opening and a lace outlet opening formed within opposing lateral sides thereof.

11. The locking device as recited in claim 1 wherein the base member is secured to the cover member by one of an adhesive, ultrasonic welding and a threaded fastener.

12. The locking device as recited in claim 1 wherein the base member is secured to the cover member by an interference fit.

13. The locking device as recited in claim 1 wherein the first surface of the base member and the first surface of the cover member each include at least one pin extending outwardly from at least one of the wall members and at least one opening extending into at least one of the wall members, the opening being generally of the same shape as the pin but being at least slightly smaller in dimension than the pin, the pin and the opening being aligned with each other when the base member is secured to the cover member such that the pin extends into and is firmly engaged by the opening for securing the base member to the cover member.

* * * * *